US005575436A

United States Patent [19]

McDermott

[11] Patent Number: 5,575,436

[45] Date of Patent: Nov. 19, 1996

[54] COMPLIANT COVERED ROLL OR DRUM

[75] Inventor: Michael F. McDermott, Lee, Mass.

[73] Assignee: Beloit Technologies, Inc., Wilmington, Del.

[21] Appl. No.: 247,212

[22] Filed: May 19, 1994

[51] Int. Cl.[6] ..... B65H 18/26

[52] U.S. Cl. ..... 242/542.4; 492/30

[58] Field of Search ..... 242/542, 542.4; 492/30, 31, 33, 34, 35, 36, 37

[56] References Cited

U.S. PATENT DOCUMENTS

| | | | |
|---|---|---|---|
| T875,026 | 6/1970 | Scharf | 492/31 X |
| 1,002,842 | 9/1911 | Harriss | 492/31 X |
| 1,204,517 | 11/1916 | Steinacker | 492/37 X |
| 1,867,550 | 7/1932 | Cameron et al. . | |
| 2,156,871 | 5/1939 | Rittenhouse | 492/34 X |
| 2,485,428 | 10/1949 | Bleier et al. | 492/31 X |
| 2,694,874 | 11/1954 | Coolidge, Jr. et al. | 492/31 X |
| 2,863,175 | 12/1958 | Meyer | 19/143 |
| 3,000,149 | 9/1961 | Johnson | 492/31 X |
| 3,198,696 | 8/1965 | Justus | 162/360 |
| 3,349,693 | 10/1967 | Mitchell, Jr. | 100/90 |
| 3,599,306 | 8/1971 | Brafford | 29/132 |
| 4,193,559 | 3/1980 | Ballard . | |
| 4,353,296 | 10/1982 | Beucker | 100/121 |
| 4,571,798 | 2/1986 | Adams | 29/121 |
| 4,880,501 | 11/1989 | Schiel | 162/358 |
| 5,134,928 | 8/1992 | Shiota | 492/37 X |

*Primary Examiner*—Daniel P. Stodola
*Assistant Examiner*—Emmanuel M. Marcelo
*Attorney, Agent, or Firm*—Dirk J. Veneman; Raymond W. Campbell; Gerald A. Mathews

[57] ABSTRACT

A winder for winding a continuous traveling web into a wound web roll including a cylindrical winder drum for being in supporting and driving relationship to a roll wound from a continuous web, a covering layer on the drum having a compliant surface with an outer surface pattern providing a series of recesses and land areas which in some preferred forms are non-uniform in shape and non-uniform in spacing but may be circular or elliptical or other defined shape within a range of sizes, spacing and a range of surface land area contact with the web and roll for reducing noise and improving tension in high speed winders.

3 Claims, 2 Drawing Sheets

COMPLIANT COVERED ROLL OR DRUM

BACKGROUND OF THE INVENTION

The invention relates to improvements in winder drums supportingly driving a roll, such as paper being wound from a continuous traveling web. More specifically, the invention relates to winder drums having a compliant covering which has a discontinuous, circumferentially interrupted pattern in its surface.

In high speed winding wherein a roll is wound from a web of paper onto a core, the web travels at speeds in excess of 4,000 feet per minute, and it is imperative that the winding progress uniformly so as to maintain a desired tension of the web on the roll and insure that the wound roll is as free as possible from defects. In this type of winder, one or two winding drums drive the wound roll, and at the high winding speeds, an undesirable noise is generated, requiring paper mill personnel to wear noise-reducing ear plugs. This noise adds to the general overall noise of other equipment and is undesirable. Where a uniform groove pattern is utilized on the drum, a tonal, or frequency specific noise, is generated by the repetitive rotation of the uniform groove. Another disadvantage of existing drums is that a drum, whether having a hard outer surface or a compliant covering, affects the web and roll differently as the roll builds up in weight. Further, undesirable induced tension in the web can result in a defective roll with crushing, tears, and wrinkles or ridges in the paper web. A standard groove or void pattern for both non-compliant and compliant covered drums utilizing the winding process is repetitive and uniform in both the machine and cross-machine directions. During the winding process, a tonal noise is produced by the repetitive sequence of a continuous, circumferentially extending void or groove area followed by a high, or protruding, or ridge area of the drum, which alternate in the longitudinal, or axial, direction with the ridge areas supporting the winding roll of web material. This continuous and tonal noise frequency or pitch is a function of a grooved drum, drum diameter, and linear, or web, speed of the machine. The foregoing problems are true whether a single drum winder is used or a twin drum winder wherein the winding roll is carried in the nest between two parallel drums.

An object of the invention is to provide an improved winding drum for use in high speed winders which substantially reduces or eliminates the noise generated between the winding drum and the roll.

A further object of the invention is to provide an improved winding drum having a compliant covering with recesses in the surface which reduce winding nip-induced tension in the wound roll of material.

A still further object of the invention is to provide an improved winding drum which avoids disadvantages of structures heretofore available and provides a surface of compliant material with recesses wherein the recesses are unique in shape, spacing and size, area and application of the area contacting the wound roll, thereby alleviating problems of induced tension and generated noise.

FEATURES OF THE INVENTION

In the inventive arrangement, a winding drum is provided for a single or a double drum winder wherein the surface of the compliant material covering the roll has recesses and corresponding land areas in the outer surface which are so shaped and arranged that surface noise is substantially reduced. The land areas can be arranged in various relationships so that in a preferred form, the land areas are so arranged as to have either a random, non-repetitive contact with the supported wound web roll, or a uniformly repetitive, but circumferentially interrupted, contact with the supported wound web roll. This is accomplished in the case of randomly arrayed land areas by having the surface openings be of non-identical shape or size and/or be of non-identical spacing from each other. In the uniformly repetitive case, the desired support of the wound web/paper roll can also be provided by circumferentially interrupted, or discontinuous, ridges, or land areas, in the outer surface of the compliant roll cover. Such circumferentially interrupted, or discontinuous, land areas are provided in the outer surface of the roll cover regardless of the size or shape of the land areas. Also, the aspect ratio, which is the ratio of the height of the protruding material between the recesses, or the depth of the recesses, to the width of the protruding material should be in the range of about 1 to about 10. The bottom of the grooves should be rounded. Also, the contact percentage of area of material left between the recesses in a ratio to the area of the recesses should be in the range of about 30% to about 75%. Various combinations may be employed as will be more apparent from the specific disclosures set forth below and as set forth in the claims.

Other objects, advantages and features will become more apparent, as will equivalent structures which are intended to be covered herein, with the teaching of the principles of the invention in connection with the disclosure of the preferred embodiments thereof in the specification, claims and drawings, in which:

DESCRIPTION OF THE PREFERRED EMBODIMENTS

Figure 1:
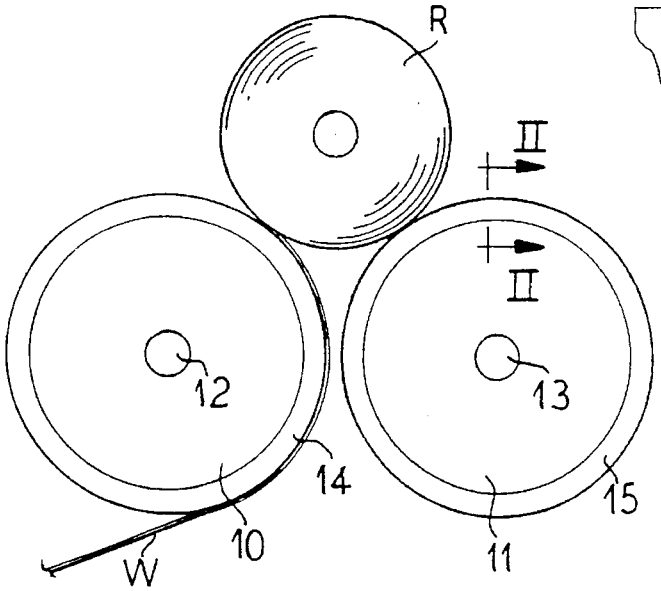
FIG. 1 is an end-elevational view of a winder illustrating a two drum support arrangement for winding a roll of paper from a continuous web supply.

As illustrated in FIG. 1, a two drum winder is shown with winding drums at 10 and 11 receiving a traveling web of paper W. The paper is fed onto the outer surface of the drum 10 which forms a winding nip with a roll R being wound with the roll being driven in rotation by either one or both of the drums 10 and 11.

The outer surface of the drum is covered with a compliant cover or covering 14 and 15, and the drums are rotatably supported on shafts 12 and 13.

Figure 2:
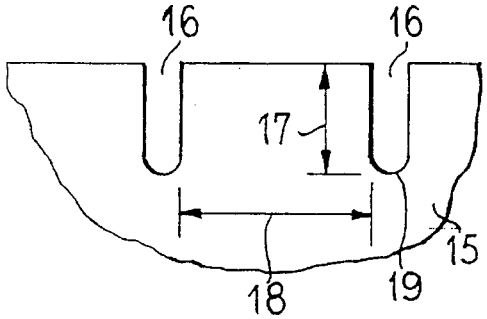
FIG. 2 is an enlarged fragmentary sectional view taken substantially along line 11—11 of FIG. 1, which shows voids or spaces in the drum surface.

The compliant covering 14 and 15 on the surfaces of the drums is uniquely equipped with recesses being shown in more detail in FIG. 2 at 16. The recesses have a depth shown at 17 and are spaced apart a width at 18. This width of spacing is preferably a random width, in one preferred embodiment, between adjacent recesses 16 along the longitudinal length of the drum so as to prevent random noise disturbances which heretofore have generated tonal noise as the drum is rotatably driven at high speed. The base of recesses shown at 19 is preferably rounded or curved.

Figure 3:
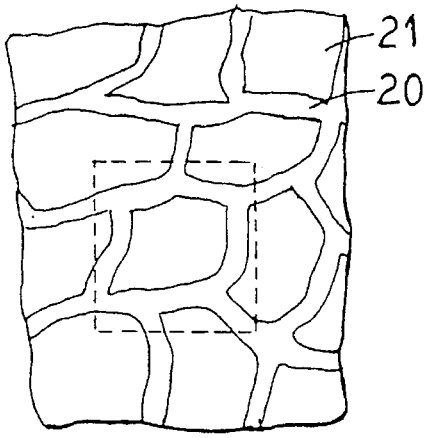
FIG. 3 and 4 are illustrations of different non-repetitive patterns for the drum surface with randomly arrayed recesses and land areas.
Figure 4:
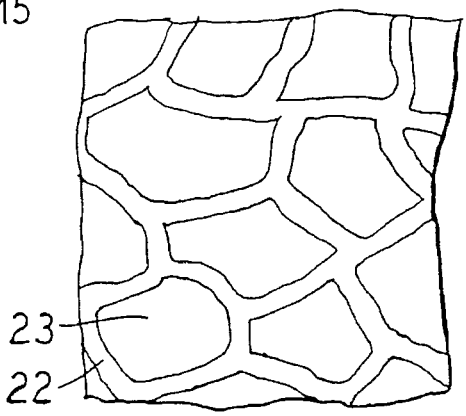

FIGS. 3 and 4 illustrate one form of random pattern which may be placed on the surface of the drum and, in this pattern, voids or spaces 20 extend between land areas 21. FIG. 4 shows another pattern of voids or spaces 22 with protruding land areas 23 therebetween.

In this description, the terms "protrusions" and "land areas" mean the same. Similarly, the terms "void", "spaces" and "recessed area" mean the same. It will be apparent that both the spacing of the voids or spaces and the shape is non-repetitive, or circumferentially discontinuous, so as to obtain the reduction in noise generation. Also, by providing the drum with a compliant cover, the variations in induced web tension, and the excessive nip unit load, which can accompany a supporting drum in engagement with a paper roll is substantially minimized to improve the quality of the roll and thereby reduce the imperfections introduced in the paper web when excess tension occurs, such as can occur when winding a very large roll.

Figure 5:
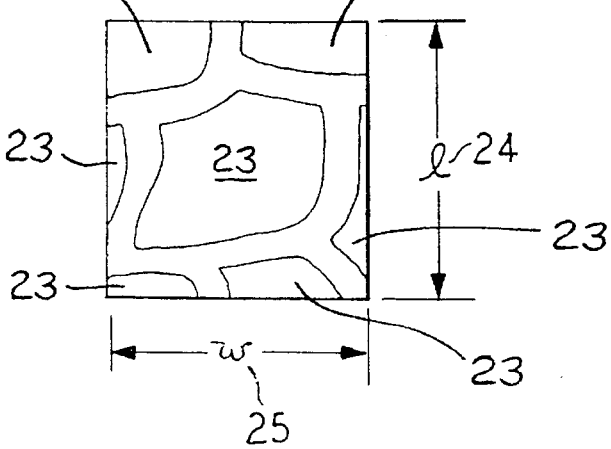
FIG. 5 is a slightly enlarged fragmentary view of a portion of the pattern of the drum surface.

FIG. 5 illustrates how the percent outer area of the protrusions or land areas 23 is computed. The sum of the individual land areas 23 within a unit area determined by width 25 and length 24 is measured. The unit area l(24)× w(25) is found. The percent of the compliant outer area is the quotient of the sum of the land areas 23 and the product of length 24 and width 25.

Figure 6:
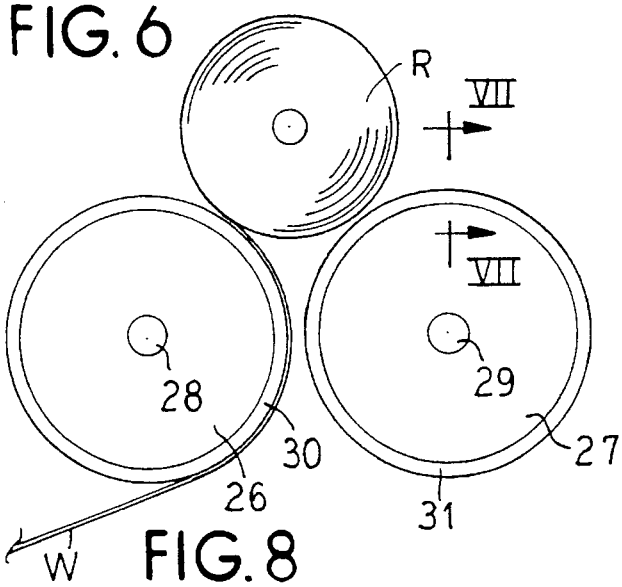
FIG. 6 is another end-elevational view showing a two drum winder.

FIG. 6 is another illustration of a two drum winder wherein a non-uniform pattern is reproduced over the compliant surface of the drum. In FIG. 6, a web is trained over a first drum 26 to be passed into a winding nip onto a winding roll R which is supported by drums 26 and 27. These drums rotate on shafts 28 and 29 and may both be driven in rotation to rotate the roll and continue the winding operation. The outer covers of the drums are formed of a compliant layer 30 and 31, such as, for example, rubber or plastic, which has a unique recess/protrusion configuration.

Figure 7:
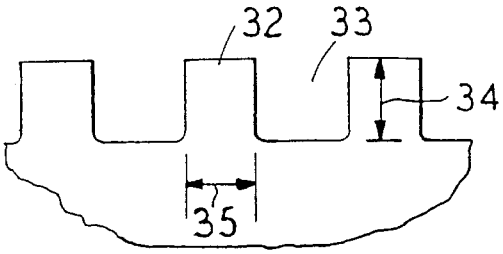
FIG. 7 is a fragmentary sectional view taken substantially along line VII—VII of FIG. 6, which shows voids or spaces in the drum surface.

FIG. 7 illustrates the appearance of the recesses and protrusions in section wherein recesses are shown at 33 and land areas therebetween at 32. The depth of the recesses is indicated by the arrowed line 34. The width of the protrusion or land area 35, or in other words, the spacing between adjacent recesses, is illustrated at 35. Various patterns in the compliant cover of the drum for the protrusions/land areas therein are shown in FIGS. 8 through 13.

Figure 8:
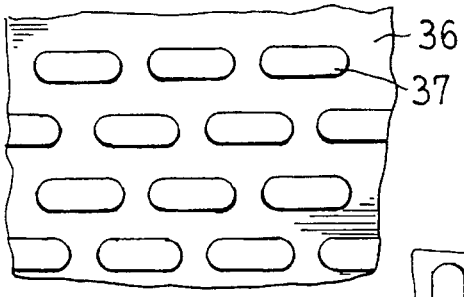
FIG. 8 is a plan view of a portion of the surface of a drum showing elongate protrusions or land areas extending in a direction substantially circumferentially of the drum.

In FIG. 8, protrusions are shown at 37 in a compliant cover with the recesses 36 having their longitudinal lengths extending circumferentially about the drum surface.

Figure 10:
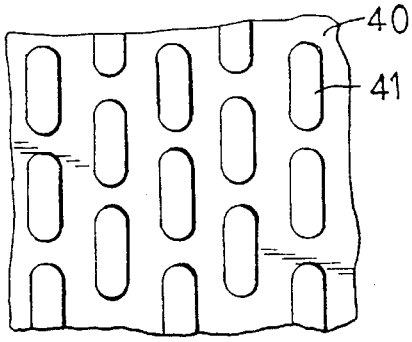
FIG. 10 is a plan view of a portion of the surface of the drum illustrating elongated land areas extending in a direction different than the arrangement in FIG. 8, such as axially, or longitudinally, along the drum surface.

In FIG. 10, the same oblong patterns are used for protrusions 41 in a compliant drum outer surface having recesses 40, but the elongate protrusions 41 extend axially, or longitudinally, along the drum.

Figure 9:
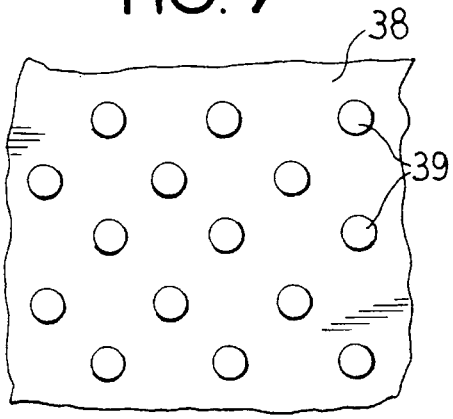
FIG. 9 is a plan view of a portion of the surface of a drum showing circular protrusions or land areas.

FIG. 9 illustrates an arrangement where circular protrusions, or land areas, 39 are utilized with the recessed area 38 comprising the compliant drum surface formed in between the protrusions.

Figure 11:
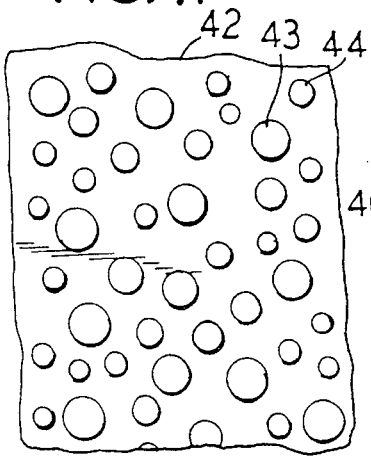
FIG. 11 is a plan view of a portion of the surface of a drum showing randomly sized and randomly spaced circular land areas.

FIG. 11 provides circular protrusions 43,44 with the plan view of the protrusions, or land areas, 43,44 having the same shape, but being of a random size, with both larger protrusions, such as 43 and smaller protrusions, such as 44, formed in the compliant drum surface 42.

Figure 12:
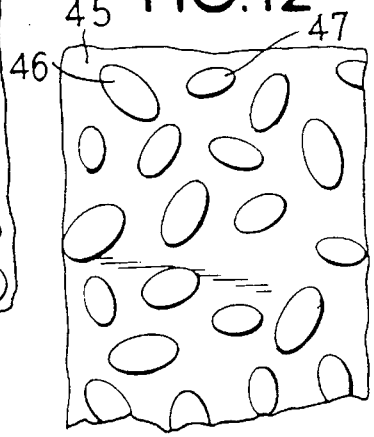
FIG. 12 is a plan view of a portion of the surface of a drum showing elliptical and areas of different sizes.

FIG. 12 illustrates a drum surface having a recessed are 45 and having elliptical protruding land areas 46,47 having the same shape, but of different sizes, with large ellipse shown at 46 and the smaller at 47. The elliptical land areas are randomly oriented in the drum surface, which preferably is made of a compliant material.

Figure 13:
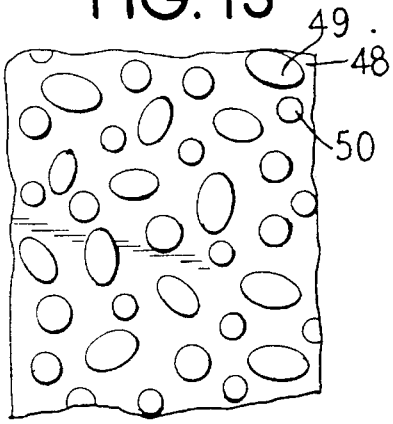
FIG. 13 is a plan view of a portion of the surface of a drum showing a combination of elliptical and circular protrusions/land areas.

FIG. 13 illustrates a surface 48 of a drum with a combination of elliptical protrusions, such as 49, and circular protrusions, such as 50. In the various shaped protrusions of FIGS. 11 through 13, the spacing between the protrusions, as well as the size of the protrusions, is random.

It has been discovered that certain optimum relationships of the protrusions are preferably followed within the confines of the invention.

The range and size for the width of the void, or spacing, or recessed area between the protrusions or land areas, where the land areas are round or elliptically shaped, should be in the range of about 0.050 inch to about 0.500 inch in a preferred recess size. For land areas which have an undefined, or random, shape, the width of the spacing between such land areas ranges between about 0.050 inch to about 0.250 inch.

The size of the recess depth from the surface of the roll to the base of the recess, or conversely, the height of the protrusion or land area from the recessed area, should be in the range of about 0.050 inch to about 0.250 inch.

The aspect ratio, which is the ratio of the depth of the void or space between land areas to the width of the land area of material between the grooves should be limited to about 1.00 to about 10.00 in a preferred practice of the invention.

Compliant material for the roll cover is preferably a hard rubber or plastic material covering the drum which would have a durometer or hardness rating in the range of about 40 to about 90 Shore "A".

The contact percentage for unit area of protruding material, that is the material between the recesses that will contact the web material, should be in the range of about 30% to about 75%. In this regard, reference is made to FIG. 5. The land unit density, or surface area of the protruding material, while random within localized areas that will contact the web over a given area, will be consistent over the entire surface of the compliant drum.

For compliant roll coverings having outer surfaces in the form of round or elliptical land areas, the diameter of round land areas would range between about 0.04 inch to about 2.00 inch. The length and width of the elliptical-shaped land areas would also range between about 0.04 inch to about 2.00 inch.

While the invention contemplates use with a compliant covered roll or drum, certain features of the random arrangement could be utilized for drums with non-compliant surfaces. The non-uniform recess pattern is repetitive over the overall surface of the drum, and it is localized repetition, such as a continuous, circumferential groove, which must be avoided to avoid the continuous and tonal noise frequency or pitch which is a trail of a uniformly grooved roll.

In operation, as shown in FIG. 1, a web W is fed over the compliant cover 14 of a drum 10 supporting a winding roll R with the web being fed into a winding nip between the drums 10,11 and the roll R. The entrance of the web onto the drum surface and the nip between the roll R and the drums 10, 11 avoids the disadvantages of previous devices by the use of the recesses which are randomly arranged, such as is shown in FIGS. 2–5 and 11–13, or are circumferentially interrupted or discontinuous, such as is shown in FIGS. 8–10, such as described. The random arrangement avoids undesirable tonal noise. The random arrangement plus the compliant surface also mitigates adverse effects of web tension in the wound paper roll which would otherwise be introduced between the drum 10 and the roll R in the nip formed therebetween.

In this invention, the compliant surface is the outer surface of the compliant drum cover 14,15 or 30,31. This outer surface is formed by the outer surfaces of the protrusions or land areas and supports the roll of web material, such as paper, being wound.

Thus, it will be seen, there has been provided an improved winding drum which meets the objects and advantages above set forth and provides a simplified structure which can be readily manufactured and used in a high speed paper web winder.

What is claimed is:

1. In a winder for winding a continuous traveling web onto a roll, the improvement comprising:

a cylindrical winder drum for supportingly driving a roll wound from the continuous web;

a covering layer on the drum, the covering layer having a compliant surface with a surface pattern of land areas and recesses for supporting the web roll on said land areas, the width of the recesses being in the range of between about 0.050 inch to about 0.250 inch, the depth of the recesses being in the range of between about 0.050 inch to about 0.250 inch, the aspect ratio of the recesses and land areas being the range of about 1.00 to about 10.00;

said layer and surface pattern arranged to provide a pattern of individually defined land areas in the outer surface thereof, the land areas being non-uniform in either size, or spacing one from the other, or both, with said recesses being distributed over the entire outer surface of the covering layer on the drum.

2. In a winder drum for winding a continuous traveling web onto a roll constructed in accordance with claim 1:

wherein the ratio of the area of the unit of surface between the recesses to the area of the recesses at the surface is expressed in percentages in the range of 30% to 75%.

3. In a winder drum for winding a continuous traveling web onto a roll constructed in accordance with claim 1:

wherein the land areas are either round or elliptical in shape and the recesses between the land areas have widths in the range of about 0.050 inch to about 0.500 inch.

* * * * *